US011214032B2

(12) United States Patent
Pettersson et al.

(10) Patent No.: US 11,214,032 B2
(45) Date of Patent: Jan. 4, 2022

(54) BOX TEMPLATE PRODUCTION SYSTEM AND METHOD

(71) Applicant: Packsize LLC, Salt Lake City, UT (US)

(72) Inventors: Niklas Pettersson, Västerås (SE); Johan Blomberg, Uppsala (SE); Graziano Bertolino, Enköping (SE); Björn Thunell, Enköping (SE); Ryan Osterhout, West Haven, UT (US)

(73) Assignee: PACKSIZE LLC, Salt Lake City, UT (US)

( * ) Notice: Subject to any disclaimer, the term of this patent is extended or adjusted under 35 U.S.C. 154(b) by 0 days.

(21) Appl. No.: 16/310,406

(22) PCT Filed: Jun. 8, 2017

(86) PCT No.: PCT/US2017/036603
§ 371 (c)(1),
(2) Date: Dec. 14, 2018

(87) PCT Pub. No.: WO2017/218296
PCT Pub. Date: Dec. 21, 2017

(65) Prior Publication Data

US 2019/0329513 A1 Oct. 31, 2019

Related U.S. Application Data

(60) Provisional application No. 62/351,127, filed on Jun. 16, 2016, provisional application No. 62/425,457, filed on Nov. 22, 2016.

(30) Foreign Application Priority Data

Dec. 19, 2016 (SE) ..... 1651682-5

(51) Int. Cl.
*B31B 50/00* (2017.01)
*B31B 50/10* (2017.01)
(Continued)

(52) U.S. Cl.
CPC ..... *B31B 50/006* (2017.08); *B31B 50/022* (2017.08); *B31B 50/046* (2017.08);
(Continued)

(58) Field of Classification Search
CPC ... B31B 50/005; B31B 50/006; B31B 50/106; B31B 50/046; B31B 50/06;
(Continued)

(56) References Cited

U.S. PATENT DOCUMENTS 1,809,853 A 6/1931 Knowlton
2,077,428 A 4/1937 Robert
(Continued)

FOREIGN PATENT DOCUMENTS

CN 2164350 5/1994
CN 1191833 9/1998
(Continued)

OTHER PUBLICATIONS

U.S. Appl. No. 62/447,714, filed Jan. 18, 2017, Osterhout.
(Continued)

*Primary Examiner* — Joshua G Kotis
(74) *Attorney, Agent, or Firm* — Workman Nydegger

(57) ABSTRACT

A method and a box template production system comprising a converting part which is configured for converting a fanfolded sheet material into box templates, wherein said converting is accomplished to the sheet material when a feed direction of the sheet material through the converting part of the system is along an axis having an angle towards a plane
(Continued)

of a floor onto which the system stands, wherein said angle is between 20 and 90 degrees.

13 Claims, 5 Drawing Sheets

(51) Int. Cl.

| | |
|---|---|
| ***B31B 50/04*** | (2017.01) |
| ***B31B 50/02*** | (2017.01) |
| ***B31B 70/00*** | (2017.01) |
| ***B31B 70/14*** | (2017.01) |
| ***B31B 70/16*** | (2017.01) |

(52) U.S. Cl.
CPC ..... *B31B 50/106* (2017.08); *B31B 70/14* (2017.08); *B31B 70/16* (2017.08); *B31B 70/25* (2017.08)

(58) Field of Classification Search
CPC ... B31B 50/144; B31B 50/254; B31B 50/066; B31B 50/042; B31B 50/102; B31B 50/00; B31D 2205/0082; B31D 1/0043; B65B 2210/04; B65H 2701/1764
USPC ..... 493/478, 479, 52
See application file for complete search history.

(56) References Cited

U.S. PATENT DOCUMENTS 2,083,351 A 7/1937 Sidebotham
2,181,117 A 11/1939 Brenn
2,256,082 A 9/1941 Feurt
2,449,663 A 9/1948 Marcalus
2,609,736 A 9/1952 Montgomery
2,631,509 A 3/1953 Whytlaw
2,679,195 A 5/1954 Whytlaw
2,699,711 A 1/1955 Mobley
2,798,582 A 7/1957 Monroe
2,904,789 A 9/1959 Radin et al.
3,057,267 A 10/1962 Johnson, Jr.
3,096,692 A 7/1963 Crathern et al.
3,105,419 A 10/1963 La Bombard
3,108,515 A 10/1963 Stohlquist
3,153,991 A * 10/1964 Goodrich ..... B31F 1/10 493/274
3,285,145 A * 11/1966 Lieberman ..... B31B 50/00 493/132
3,303,759 A 2/1967 Burke
3,308,723 A * 3/1967 Bergh, Jr. ..... B31B 50/00 493/354
3,332,207 A 7/1967 Midnight
3,406,611 A * 10/1968 Gwinn ..... B31B 70/00 493/220
3,418,893 A 12/1968 Stohlquist
3,469,508 A 9/1969 Klapp
3,511,496 A 5/1970 Zoglmann
3,543,469 A 12/1970 Ullman
3,555,776 A 1/1971 Nigrelli et al.
3,566,755 A 3/1971 Smith et al.
3,611,884 A * 10/1971 Hottendorf ..... B31B 50/00 493/55
3,618,479 A 11/1971 Shields
3,628,408 A 12/1971 Rod et al.
3,646,418 A 2/1972 Sterns et al.
3,743,154 A 7/1973 Brewitz
3,763,750 A 10/1973 Reichert
3,776,109 A 12/1973 Clark et al.
3,803,798 A 4/1974 Clancy
3,804,514 A 4/1974 Jasinski
3,807,726 A 4/1974 Hope
3,866,391 A 2/1975 Puskarz et al.
3,882,764 A 5/1975 Johnson
3,886,833 A 6/1975 Gunn et al.
3,891,203 A 6/1975 Schiff
3,912,389 A 10/1975 Miyamoto
3,913,464 A 10/1975 Flaum
3,949,654 A 4/1976 Stehlin
3,986,319 A 10/1976 Puskarz et al.
4,033,217 A 7/1977 Flaum et al.
4,044,658 A 8/1977 Mitchard
4,052,048 A 10/1977 Shirasaka
4,056,025 A 11/1977 Rubel
4,094,451 A 6/1978 Wescoat
4,121,506 A 10/1978 Van Grouw
4,123,966 A 11/1978 Buschor
4,164,171 A 8/1979 Meyers et al.
4,173,106 A 11/1979 Garcia et al.
4,184,770 A 1/1980 Pinior
4,191,467 A 3/1980 Schieck
4,221,373 A * 9/1980 Muller Hans ..... B65H 45/12 270/52.26
4,224,847 A 9/1980 Tokuno
4,252,233 A 2/1981 Joice
4,261,239 A 4/1981 Toboshi et al.
4,264,200 A 4/1981 Tickner
4,295,841 A 10/1981 Ward, Jr.
4,320,960 A 3/1982 Ward et al.
4,342,562 A 8/1982 Froeidh et al.
4,368,052 A 1/1983 Bitsky et al.
4,373,412 A 2/1983 Gerber et al.
4,375,970 A 3/1983 Murphy
4,401,250 A 8/1983 Carlsson
4,449,349 A 5/1984 Roth
4,487,596 A 12/1984 Livens et al.
4,563,169 A 1/1986 Virta et al.
4,578,054 A 3/1986 Herrin
D286,044 S 10/1986 Kando
4,638,696 A 1/1987 Urwyler
4,684,360 A 8/1987 Tokuno et al.
4,695,006 A 9/1987 Pool
4,714,946 A 12/1987 Bajgert
4,743,131 A 5/1988 Atwell
4,749,295 A 6/1988 Bankier
4,773,781 A 9/1988 Bankier
4,838,468 A 6/1989 Lesse
4,844,316 A 7/1989 Keeny
4,847,632 A 7/1989 Norris
4,878,521 A 11/1989 Fredrickson
4,887,412 A 12/1989 Takamura
4,923,188 A 5/1990 Neir
4,932,930 A 6/1990 Coalier et al.
4,979,932 A 12/1990 Burnside
4,994,008 A 2/1991 Haake et al.
5,005,816 A 4/1991 Stemmler
5,030,192 A 7/1991 Sager
5,039,242 A 8/1991 Johnson
5,046,716 A 9/1991 Lippold
5,058,872 A 10/1991 Gladow
5,072,641 A 12/1991 Urban et al.
5,074,836 A 12/1991 Fechner et al.
5,081,487 A 1/1992 Hoyer
5,090,281 A 2/1992 Paulson
5,094,660 A * 3/1992 Okuzawa ..... B65H 29/70 271/178
5,106,359 A 4/1992 Lott
5,111,252 A 5/1992 Hamada
5,118,093 A 6/1992 Makiura
5,120,279 A 6/1992 Adami
5,120,297 A 6/1992 Adami
5,123,890 A 6/1992 Green
5,123,894 A 6/1992 Bergeman
5,137,172 A 8/1992 Wagner
5,137,174 A 8/1992 Bell
5,148,654 A 9/1992 Kisters
5,154,041 A 10/1992 Schneider
5,157,903 A 10/1992 Nakashima et al.
5,197,366 A 3/1993 Paulson
5,240,243 A 8/1993 Gompertz
5,241,353 A 8/1993 Maeshima
5,259,255 A 11/1993 Urban et al.
5,263,785 A 11/1993 Negoro
D344,751 S 3/1994 Keong

(56) References Cited

U.S. PATENT DOCUMENTS 5,321,464 A 6/1994 Jessen
2,353,419 A 7/1994 Smithson
5,335,777 A 8/1994 Murphy
5,358,345 A 10/1994 Damitio
5,369,939 A 12/1994 Moen et al.
5,375,390 A 12/1994 Frigo et al.
5,397,423 A 3/1995 Bantz et al.
5,411,252 A 5/1995 Lowell
5,584,633 A 12/1996 Scharer
5,586,758 A 12/1996 Kimura
5,624,369 A 4/1997 Bidlack et al.
5,667,468 A 9/1997 Bandura
5,671,593 A 9/1997 Ginestra et al.
5,716,313 A 2/1998 Sigrist et al.
5,727,725 A 3/1998 Paskvich
5,767,975 A 6/1998 Ahlen
5,836,498 A 11/1998 Turek
5,902,223 A 5/1999 Simmons
5,927,702 A 7/1999 Ishii
5,941,451 A 8/1999 Dexter
5,964,686 A 12/1999 Bidlack et al.
6,000,525 A 12/1999 Frulio
6,071,223 A 6/2000 Reider et al.
6,113,525 A 9/2000 Waechter
6,164,045 A 12/2000 Focke
6,189,933 B1 2/2001 Felderman
6,245,004 B1 6/2001 Waters
6,321,650 B1 11/2001 Ogawa
6,397,557 B1 6/2002 Bassissi
6,428,000 B1 8/2002 Hara
6,471,154 B1 10/2002 Zsolt
6,553,207 B2 4/2003 Tsusaka
6,568,865 B1 5/2003 Fujioka
6,673,001 B2 * 1/2004 Toth ..... B31D 5/0047 493/365
6,690,476 B1 2/2004 Hren
6,830,328 B2 12/2004 Cuyler, Jr.
6,837,135 B2 1/2005 Michalski
6,840,898 B2 1/2005 Pettersson
6,910,997 B1 * 6/2005 Yampolsky ..... B26F 1/22 493/350
6,968,859 B1 11/2005 Nagano et al.
7,060,016 B2 6/2006 Cipolli
7,100,811 B2 9/2006 Pettersson
7,115,086 B1 10/2006 Campbell, Jr.
7,121,543 B2 10/2006 Fujioka
7,201,089 B2 * 4/2007 Richter ..... B65H 5/30 270/52.17
7,237,969 B2 7/2007 Bartman
7,537,557 B2 * 5/2009 Holler ..... B65H 45/22 493/241
7,637,857 B2 12/2009 Coullery et al.
7,641,190 B2 1/2010 Hara
7,647,752 B2 1/2010 Magnell
7,648,451 B2 1/2010 Calugi
7,648,596 B2 1/2010 Sharpe et al.
7,690,099 B2 4/2010 Bapst et al.
7,997,578 B2 8/2011 Saito
D703,246 S 4/2014 Pettersson et al.
8,999,108 B2 4/2015 Nagao et al.
9,069,151 B2 6/2015 Conner
9,120,284 B2 9/2015 Capoia
9,199,794 B2 12/2015 Nadachi et al.
9,329,565 B2 5/2016 Osaki
9,352,526 B2 5/2016 Pettersson et al.
9,434,496 B2 9/2016 Sytema
9,969,142 B2 5/2018 Pettersson et al.
10,093,438 B2 10/2018 Pettersson
10,155,352 B2 12/2018 Sytema et al.
10,286,621 B2 5/2019 Toro
10,583,943 B2 3/2020 Feijen et al.
10,836,516 B2 11/2020 Pettersson
10,836,517 B2 11/2020 Ponti
2002/0017754 A1 2/2002 Kang
2002/0066683 A1 6/2002 Sanders
2002/0091050 A1 7/2002 Bacciottini
2002/0115548 A1 8/2002 Lin et al.
2002/0125712 A1 9/2002 Felderman
2002/0139890 A1 10/2002 Toth
2003/0102244 A1 6/2003 Sanders
2003/0217628 A1 11/2003 Michalski
2004/0060264 A1 4/2004 Miller
2004/0082453 A1 4/2004 Pettersson
2004/0092374 A1 5/2004 Chiu-Fu
2004/0144555 A1 7/2004 Buekers et al.
2004/0173068 A1 9/2004 Adachi
2004/0198577 A1 * 10/2004 Blumle ..... B26D 7/1863 493/413
2004/0214703 A1 10/2004 Berens et al.
2004/0261365 A1 12/2004 White
2005/0079965 A1 4/2005 Moshier et al.
2005/0103923 A1 5/2005 Pettersson
2005/0215409 A1 9/2005 Abramson et al.
2005/0280202 A1 12/2005 Vila
2006/0178248 A1 8/2006 Coullery et al.
2006/0180438 A1 8/2006 Mosli et al.
2006/0180991 A1 8/2006 Nakahata et al.
2006/0181008 A1 8/2006 Van Gerven
2007/0079575 A1 4/2007 Monti
2007/0227927 A1 10/2007 Coltri-Johnson
2007/0228119 A1 10/2007 Barner
2007/0287623 A1 12/2007 Carlson
2007/0289253 A1 12/2007 Miller
2008/0020916 A1 1/2008 Magnell
2008/0037273 A1 2/2008 Muehlemann et al.
2008/0066632 A1 3/2008 Raueiser
2008/0115641 A1 5/2008 Freyburger et al.
2008/0148917 A1 6/2008 Pettersson
2008/0300120 A1 12/2008 Sato
2009/0062098 A1 3/2009 Inoue et al.
2009/0178528 A1 7/2009 Adami
2009/0199527 A1 8/2009 Wehr et al.
2010/0041534 A1 2/2010 Harding
2010/0111584 A1 5/2010 Shiohara
2010/0206582 A1 8/2010 Meyyappan et al.
2010/0210439 A1 8/2010 Goto
2011/0026999 A1 2/2011 Kohira
2011/0053746 A1 3/2011 Desertot et al.
2011/0092351 A1 4/2011 Hatano
2011/0099782 A1 5/2011 Schonberger
2011/0110749 A1 5/2011 Carter et al.
2011/0171002 A1 7/2011 Pettersson
2011/0229191 A1 9/2011 Nomi
2011/0230325 A1 9/2011 Harding et al.
2011/0319242 A1 9/2011 Pettersson
2011/0283855 A1 11/2011 Kwarta et al.
2012/0021884 A1 1/2012 Musha
2012/0106963 A1 5/2012 Huang et al.
2012/0122640 A1 5/2012 Pazdernik et al.
2012/0129670 A1 5/2012 Pettersson et al.
2012/0139670 A1 6/2012 Yamagata
2012/0142512 A1 * 6/2012 Keller ..... B31D 5/0047 493/461
2012/0319920 A1 12/2012 Athley et al.
2012/0328253 A1 12/2012 Hurley et al.
2013/0000252 A1 1/2013 Pettersson et al.
2013/0045847 A1 2/2013 Capoia
2013/0104718 A1 5/2013 Tai
2013/0108227 A1 5/2013 Conner
2013/0130877 A1 5/2013 Su
2013/0146355 A1 6/2013 Strasser et al.
2013/0210597 A1 8/2013 Pettersson
2013/0294735 A1 11/2013 Burris et al.
2013/0333538 A1 12/2013 Long et al.
2014/0078635 A1 3/2014 Conner et al.
2014/0091511 A1 3/2014 Martin
2014/0101929 A1 4/2014 Kim
2014/0140671 A1 5/2014 Islam
2014/0315701 A1 * 10/2014 Pettersson ..... B26D 1/185 493/56
2014/0336026 A1 11/2014 Pettersson
2014/0357463 A1 12/2014 Kojima
2015/0018189 A1 1/2015 Pettersson et al.
2015/0019387 A1 1/2015 Pettersson

(56) References Cited

U.S. PATENT DOCUMENTS

| | | | |
|---|---|---|---|
| 2015/0053349 | A1 | 2/2015 | Mori et al. |
| 2015/0055926 | A1 | 2/2015 | Strasser et al. |
| 2015/0103923 | A1 | 4/2015 | Rarasubramonian et al. |
| 2015/0148210 | A1 | 5/2015 | Sibthorpe |
| 2015/0155697 | A1 | 6/2015 | Loveless et al. |
| 2015/0224731 | A1 | 8/2015 | Ponti |
| 2015/0273897 | A1 | 10/2015 | Kato |
| 2015/0355429 | A1 | 12/2015 | Villegas et al. |
| 2015/0360433 | A1 | 12/2015 | Feijen et al. |
| 2015/0360801 | A1 | 12/2015 | Sytema |
| 2016/0001441 | A1 | 1/2016 | Osterhout et al. |
| 2016/0049782 | A1 | 2/2016 | Strasser et al. |
| 2016/0122044 | A1 | 5/2016 | Evers |
| 2016/0184142 | A1* | 6/2016 | Vanvalkenburgh ..... A61F 13/15772 493/477 |
| 2016/0185065 | A1 | 6/2016 | Sytema et al. |
| 2016/0185475 | A1 | 6/2016 | Pettersson et al. |
| 2016/0241468 | A1 | 8/2016 | Sabella et al. |
| 2016/0340067 | A1 | 11/2016 | Winkler et al. |
| 2017/0190134 | A1 | 7/2017 | Van et al. |
| 2017/0355166 | A1 | 12/2017 | Jonker |
| 2017/0361560 | A1 | 12/2017 | Osterhout |
| 2018/0178476 | A1 | 6/2018 | Pettersson et al. |
| 2018/0201465 | A1 | 7/2018 | Osterhout |
| 2018/0265228 | A1 | 9/2018 | Hagestedt |
| 2019/0002137 | A1 | 1/2019 | Pettersson |
| 2019/0184670 | A1 | 6/2019 | Davies et al. |
| 2019/0308383 | A1 | 10/2019 | Provoost et al. |
| 2019/0308761 | A1 | 10/2019 | Provoost et al. |
| 2019/0389611 | A1 | 12/2019 | Pettersson |
| 2020/0031506 | A1 | 1/2020 | Ponti |
| 2020/0101686 | A1 | 4/2020 | Fredander et al. |
| 2020/0407087 | A1 | 12/2020 | Pettersson |
| 2021/0001583 | A1 | 1/2021 | Osterhout |
| 2021/0039347 | A1 | 2/2021 | Pettersson et al. |
| 2021/0261281 | A1 | 8/2021 | Engleman et al. |

FOREIGN PATENT DOCUMENTS

| | | | |
|---|---|---|---|
| CN | 1366487 | | 8/2002 |
| CN | 1449966 | A | 10/2003 |
| CN | 1876361 | | 12/2006 |
| CN | 2925862 | Y | 7/2007 |
| CN | 201941185 | U | 8/2011 |
| CN | 201990294 | U | 9/2011 |
| CN | 102371705 | | 3/2012 |
| CN | 202412794 | | 9/2012 |
| CN | 102753442 | | 10/2012 |
| CN | 102791581 | A | 11/2012 |
| CN | 104169073 | | 11/2014 |
| CN | 104185538 | | 12/2014 |
| CN | 102941592 | | 4/2015 |
| CN | 104812560 | A | 7/2015 |
| CN | 104890208 | A | 9/2015 |
| CN | 104985868 | A | 10/2015 |
| CN | 204773785 | | 11/2015 |
| CN | 204773785 | U * | 11/2015 |
| CN | 106079570 | A | 11/2016 |
| CN | 107614253 | A | 1/2018 |
| DE | 1082227 | | 5/1960 |
| DE | 1212854 | | 3/1966 |
| DE | 2700004 | A1 | 7/1978 |
| DE | 2819000 | A1 | 11/1978 |
| DE | 3343523 | A1 | 6/1985 |
| DE | 3825506 | A1 | 2/1990 |
| DE | 19541061 | C1 | 11/1996 |
| DE | 10355544 | | 6/2005 |
| DE | 102005063193 | | 7/2007 |
| DE | 102008035278 | | 4/2010 |
| EP | 0030366 | | 6/1981 |
| EP | 0234228 | A2 | 9/1987 |
| EP | 0359005 | | 3/1990 |
| EP | 650827 | | 5/1995 |
| EP | 889779 | | 1/1999 |
| EP | 903219 | | 3/1999 |
| EP | 1065162 | | 1/2001 |
| EP | 1223107 | | 7/2002 |
| EP | 1373112 | | 1/2004 |
| EP | 1428759 | A2 | 6/2004 |
| EP | 1997736 | | 12/2008 |
| EP | 1497049 | | 3/2010 |
| EP | 2228206 | | 9/2010 |
| EP | 2377764 | A1 | 10/2011 |
| EP | 3231594 | A1 | 10/2017 |
| FR | 428967 | | 9/1911 |
| FR | 1020458 | | 2/1953 |
| FR | 1592372 | | 5/1970 |
| FR | 2280484 | A1 | 2/1976 |
| FR | 2626642 | A1 | 8/1989 |
| FR | 2721301 | | 12/1995 |
| FR | 2770445 | | 5/1999 |
| FR | 2808722 | | 11/2001 |
| FR | 2814393 | A1 | 3/2002 |
| FR | 2976561 | | 12/2012 |
| GB | 0166622 | | 7/1921 |
| GB | 983946 | | 2/1965 |
| GB | 1362060 | | 7/1974 |
| GB | 1546789 | A | 5/1979 |
| JP | 49-099239 | A | 9/1974 |
| JP | 50-078616 | A | 6/1975 |
| JP | 51-027619 | A | 3/1976 |
| JP | S5557984 | A | 4/1980 |
| JP | S5689937 | | 7/1981 |
| JP | S59176836 | | 10/1984 |
| JP | 59-198243 | A | 11/1984 |
| JP | S61118720 | | 7/1986 |
| JP | 62-172032 | | 10/1987 |
| JP | 01-133164 | A | 5/1989 |
| JP | 03-070927 | A | 3/1991 |
| JP | 3089399 | | 9/1991 |
| JP | 07-156305 | A | 6/1995 |
| JP | H08238690 | | 9/1996 |
| JP | H08333036 | | 12/1996 |
| JP | 2000323324 | | 11/2000 |
| JP | 2003079446 | | 3/2003 |
| JP | 2003-112849 | A | 4/2003 |
| JP | 2004-330351 | A | 11/2004 |
| JP | 2005067019 | | 3/2005 |
| JP | 2005219798 | | 8/2005 |
| JP | 2006289914 | | 10/2006 |
| JP | 2008254789 | | 10/2008 |
| JP | 2009-023074 | | 2/2009 |
| JP | 2009132049 | | 6/2009 |
| JP | 2010-012628 | A | 1/2010 |
| JP | 2011520674 | | 7/2011 |
| JP | 2011230385 | | 11/2011 |
| JP | 2016-074133 | A | 5/2016 |
| RU | 2015030 | | 6/1994 |
| RU | 2004136918 | | 5/2006 |
| RU | 2334668 | C2 | 9/2008 |
| RU | 2345893 | C2 | 2/2009 |
| RU | 2398674 | | 9/2010 |
| RU | 2014123534 | A | 12/2015 |
| RU | 2014123562 | A | 12/2015 |
| SE | 450829 | | 8/1987 |
| SE | 450829 | B | 8/1987 |
| SE | 515630 | C2 | 9/2001 |
| SU | 40025 | A1 | 12/1934 |
| SU | 992220 | A1 | 1/1983 |
| SU | 1054863 | | 11/1983 |
| SU | 1121156 | A1 | 10/1984 |
| SU | 1676825 | A1 | 9/1991 |
| SU | 1718783 | | 3/1992 |
| SU | 1756211 | A1 | 8/1992 |
| WO | 199614773 | | 6/1996 |
| WO | 1999/017923 | | 4/1999 |
| WO | 00/21713 | A1 | 4/2000 |
| WO | 01/04017 | A1 | 1/2001 |
| WO | 01/85408 | A2 | 11/2001 |
| WO | 2003089163 | | 10/2003 |
| WO | 03/97340 | | 11/2003 |
| WO | 2009/093936 | A1 | 7/2009 |

(56) References Cited

FOREIGN PATENT DOCUMENTS

| | | | |
|---|---|---|---|
| WO | 2010091043 | A1 | 8/2010 |
| WO | 2011007237 | | 1/2011 |
| WO | 2011100078 | | 8/2011 |
| WO | 2011135433 | | 11/2011 |
| WO | 2012003167 | | 1/2012 |
| WO | 2013071073 | | 5/2013 |
| WO | 2013071080 | | 7/2013 |
| WO | 2013106180 | A1 | 7/2013 |
| WO | 2013114057 | | 8/2013 |
| WO | 2014/048934 | A1 | 4/2014 |
| WO | 2014/117816 | | 8/2014 |
| WO | 2014/117817 | A1 | 8/2014 |
| WO | 2016/176271 | | 11/2016 |
| WO | 2017/203399 | A1 | 11/2017 |
| WO | 2017203401 | | 11/2017 |
| WO | 2017218296 | | 12/2017 |
| WO | 2017218297 | | 12/2017 |

OTHER PUBLICATIONS

U.S. Appl. No. 15/872,770, filed Jan. 16, 2018, Osterhout.
International Search Report and Written Opinion for PCT/US2015/67375 dated Mar. 11, 2016.
International Search Report and Written Opinion for PCT/US18/14275 dated Apr. 4, 2018.
International Search Report and Written Opinion for PCT/US2018/020928 dated Jun. 7, 2018.
International Search Report and Written Opinion PCT/IB2019/052794 dated Jun. 19, 2019.
International Search Report and Written Opinion for PCT/US2019/038142 dated Aug. 2, 2019.
International Search Report and Written Opinion PCT/IB2019/052793 dated Nov. 11, 2019.
International Search Report and Written Opinion for PCT/US2019/049102 dated Dec. 2, 2019.
International Search Report and Written Opinion for PCT/US19/62696 dated Feb. 4, 2020.
U.S. Appl. No. 13/805,602, Mar. 21, 2016, Notice of Allowance.
U.S. Appl. No. 14/370,729, May 21, 2018, Notice of Allowance.
U.S. Appl. No. 15/901,089, Apr. 13, 2020, Office Action.
U.S. Appl. No. 14/970,224, May 30, 2018, Office Action.
U.S. Appl. No. 14/970,224, Aug. 13, 2018, Notice of Allowance.
U.S. Appl. No. 16/109,261, Apr. 28, 2020, Office Action.
U.S. Appl. No. 15/616,688, Mar. 19, 2020, Office Action.
U.S. Appl. No. 15/872,770, Mar. 27, 2020, OfifceAction.
International Search Report and Written Opinion for application No. PCT/US2010/022983 dated Apr. 13, 2010.
International Search Report and Wirtten Opinion for application No. PCT/US2012/070719 dated Feb. 25, 2013.
International Search Report and Written Opininon for application No. PCT/US2017/036606 dated Oct. 24, 2017.
International Search Report for PCT/US2011/042096 dated Oct. 28, 2011.
European Search Report for EP10739040 dated Jan. 31, 2013.
European Search Report for EP80107577.1 dated Mar. 2, 1981.
European Search Report for EP89115688.7 dated Nov. 2, 1989.
International Search Report and Written Opinion for PCT/US2012/064414 dated Jan. 25, 2013.
International Search Report and Written Opinion for PCT/US2012/064403 dated Apr. 8, 2013.
European Search Report for EP12848321 dated Jul. 1, 2015.
European Search Report for EP12865028 dated Jul. 7, 2015.
European Search Report for EP16169030 dated Dec. 16, 2016, dated Jan. 5, 2017.
European Search Report for application No. EP17175751 dated Aug. 25, 2017.
Japanese Office Action for application No. 2017-000038 dated Sep. 22, 2017.
U.S. Appl. No. 13/147,787, Aug. 27, 2014, Office Action.
U.S. Appl. No. 13/147,787, Apr. 17, 2015, Final Office Action.
U.S. Appl. No. 13/147,787, Sep. 30, 2015, Office Action.
U.S. Appl. No. 13/147,787, Feb. 16, 2016, Final Office Action.
U.S. Appl. No. 13/147,787, Oct. 28, 2016, Office Action.
U.S. Appl. No. 13/147,787, Mar. 7, 2017, Final Office Action.
U.S. Appl. No. 13/147,787, Jun. 26, 2017, Notice of Allowance.
U.S. Appl. No. 13/805,602, Dec. 2, 2015, Office Action.
U.S. Appl. No. 14/357,183, Jul. 16, 2015, Office Action.
U.S. Appl. No. 14/357,183, Nov. 12, 2015, Final Office Action.
U.S. Appl. No. 14/357,183, Jan. 29, 2016, Notice of Allowance.
U.S. Appl. No. 14/357,190, Feb. 17, 2017, Office Action.
U.S. Appl. No. 14/357,190, Aug. 1, 2017, Final Office Action.
U.S. Appl. No. 14/357,190, Dec. 5, 2017, Notice of Allowance.
U.S. Appl. No. 14/357,190, Jan. 12, 2018, Notice of Allowance.
U.S. Appl. No. 14/370,729, Jan. 26, 2017, Office Action.
U.S. Appl. No. 14/370,729, Jul. 12, 2017, Final Office Action.
U.S. Appl. No. 14/370,729, Dec. 19, 2017, Office Action.
U.S. Appl. No. 29/419,922, Aug. 6, 2013, Office Action.
U.S. Appl. No. 29/419,922, Nov. 29, 2013, Notice of Allowance.
International Search Report and Written Opinion, European International Search Authority, completed Sep. 28, 2017 completed, PCT/US2017/036603.
Final Office Action received for U.S. Appl. No. 13/147,787 dated Apr. 17, 2015.
Final Office Action received for U.S. Appl. No. 13/147,787 dated Feb. 16, 2016.
Final Office Action received for U.S. Appl. No. 13/147,787 dated Mar. 7, 2017.
Final Office Action received for U.S. Appl. No. 14/357,183 dated Nov. 12, 2015.
Final Office Action received for U.S. Appl. No. 14/357,190 dated Aug. 1, 2017.
International Search Report and Written Opinion for application No. PCT/US2017/036603 dated Oct. 18, 2017.
International Search Report and Written Opinion received for PCT Patent Application No. PCT/US2019/049535, dated Jun. 9, 2020, 14 pages.
International Search Report and Written Opinion received for PCT Patent Application No. PCT/US2020/012519, dated Jun. 26, 2020, 20 pages.
International Search Report and Written Opinion, PCT/US2012/064414, US Search Authority, Completed Jan. 4, 2013, dated Jan. 25, 2013.
Notification Concerning Transmittal of International Preliminary Report on Patentability for corresponding PCT Application No. PCT/IB2015/054179, dated Dec. 15, 2016, 10 pages.
Office Action received for U.S. Appl. No. 13/147,787 dated Aug. 27, 2014.
Office Action received for U.S. Appl. No. 13/147,787 dated Oct. 28, 2016.
Office Action received for U.S. Appl. No. 13/147,787 dated Sep. 30, 2015.
Office Action received for U.S. Appl. No. 13/805,602 dated Dec. 2, 2015.
Office Action received for U.S. Appl. No. 14/357,183 dated Jul. 16, 2015.
Office Action received for U.S. Appl. No. 14/357,190 dated Feb. 17, 2017.
Office Action received for U.S. Appl. No. 14/370,729 dated Dec. 19, 2017.
Office Action received for U.S. Appl. No. 29/419,922 dated Aug. 6, 2013.
U. S. Patent Application mailed on Dec. 14, 2018, filed by Pettersson et al., U.S. Appl. No. 16/310,406.
Final Office Action received for U.S. Appl. No. 15/872,770, dated Sep. 16, 2020, 17 pages.
Non-Final Office Action received for U.S. Appl. No. 15/872,770, dated Nov. 10, 2020, 24 pages.
International Preliminary Report on Patentability received for PCT Patent Application No. PCT/US2019/038142, dated Dec. 30, 2020, 8 pages.
International Search Report and Written Opinion for corresponding PCT Application No. PCT/IB2015/054179, dated Aug. 28, 2015, 13 pages.

(56) References Cited

OTHER PUBLICATIONS

International Search Report and Written Opinion issued in PCT/US2018/032311 dated Sep. 20, 2018.
U.S. Appl. No. 16/435,252, filed Jun. 7, 2019.
Non-Final Office Action received for U.S. Appl. No. 16/375,579, dated Feb. 18, 2021, 12 pages.
Non-Final Office Action received for U.S. Appl. No. 16/375,588, dated Jul. 2, 2021, 15 pages.
Non-Final Office Action received for U.S. Appl. No. 16/619,818, dated Aug. 31, 2021, 13 pages.

* cited by examiner

BOX TEMPLATE PRODUCTION SYSTEM AND METHOD

CROSS-REFERENCE TO RELATED APPLICATIONS

This application claims priority to PCT Application No. PCT/US2017/036603, filed Jun. 8, 2017, entitled "A BOX TEMPLATE PRODUCTION SYSTEM AND METHOD", which claims the benefit of and priority to U.S. Provisional Application Nos. 62/351,127 filed Jun. 16, 2016 and 62/425,457 filed Nov. 22, 2016 and Sweden Application No. 1651682-5 filed Dec. 19, 2016. All the aforementioned applications are incorporated by reference herein in their entirety.

TECHNICAL FIELD OF THE INVENTION

The present invention relates to a box template production system and a method for converting a fanfolded sheet material into box templates.

RELATED ART

Shipping and packaging industries frequently use cardboard and other sheet material processing equipment that converts sheet materials into box templates. One advantage of such equipment is that a shipper may prepare boxes of required sizes as needed in lieu of keeping a stock of standard, pre-made boxes of various sizes. Consequently, the shipper can eliminate the need to forecast its requirements for particular box sizes as well as to store pre-made boxes of standard sizes. Instead, the shipper may store one or more bales of fanfold material, which can be used to generate a variety of box sizes based on the specific box size requirements at the time of each shipment. This allows the shipper to reduce storage space normally required for periodically used shipping supplies as well as reduce the waste and costs associated with the inherently inaccurate process of forecasting box size requirements, as the items shipped and their respective dimensions vary from time to time.

In addition to reducing the inefficiencies associated with storing pre-made boxes of numerous sizes, creating custom sized boxes also reduces packaging and shipping costs. In the fulfillment industry it is estimated that shipped items are typically packaged in boxes that are about 65% larger than the shipped items. Boxes that are too large for a particular item are more expensive than a box that is custom sized for the item due to the cost of the excess material used to make the larger box. When an item is packaged in an oversized box, filling material (e.g., Styrofoam, foam peanuts, paper, air pillows, etc.) is often placed in the box to prevent the item from moving inside the box and to prevent the box from caving in when pressure is applied (e.g., when boxes are taped closed or stacked). These filling materials further increase the cost associated with packing an item in an oversized box.

Customized sized boxes also reduce the shipping costs associated with shipping items compared to shipping the items in oversized boxes. A shipping vehicle filled with boxes that are 65% larger than the packaged items is much less cost efficient to operate than a shipping vehicle filled with boxes that are custom sized to fit the packaged items. In other words, a shipping vehicle filled with custom sized packages can carry a significantly larger number of packages, which can reduce the number of shipping vehicles required to ship the same number of items. Accordingly, in addition or as an alternative to calculating shipping prices based on the weight of a package, shipping prices are often affected by the size of the shipped package. Thus, reducing the size of an item's package can reduce the price of shipping the item. Even when shipping prices are not calculated based on the size of the packages (e.g., only on the weight of the packages), using custom sized packages can reduce the shipping costs because the smaller, custom sized packages will weigh less than oversized packages due to using less packaging and filling material.

A typical box template production system includes a converting part that cuts, scores, and/or creases sheet material to form a box template. The sheet material is provided to the system from fanfolded bales and needs to be guided correctly into the converting part of the system. Prior art systems often guide the sheet material up and over a top position by means of wheels or rails and down again to a suitable working height for entering the converting part of the system. The converting part is positioned such that the box template is delivered out from the converting part for example directly on a work table or conveyor belt provided next to the outlet of the system for further processing of the box template into a box. The guiding of the sheet material from the bales into the converting part of the machine requires force and precision. The force required is a function of the amount of material that is being accelerated, and how much friction is created due to its bending through the guide system, and the force required to control the precise direction of the material. It is therefore essential to limit these factors. This guiding of sheet material also requires space in the room.

SUMMARY

An object of the present invention is to provide an improved method for converting a fanfolded sheet material into a box template and an improved box template production system.

This is achieved in a box template production system and a method according to the independent claims.

In one aspect of the invention a box template production system comprising a converting part which is configured for converting a fanfolded sheet material into box templates is provided. Said converting is accomplished to the sheet material when a feed direction of the sheet material through the converting part of the system is along an axis having an angle towards a plane of a floor onto which the system stands, wherein said angle is between 20 and 90 degrees.

In another aspect of the invention a method for converting a fanfolded sheet material into a box template is provided. Said method comprises the steps of:

- feeding the sheet material into a box template production system;
- converting the sheet material into box templates when a feed direction of the sheet material through a converting part of the box template production system is along an axis having an angle towards a plane of a floor onto which the system stands, wherein said angle is between 20 and 90 degrees.

Hereby a method for converting a fanfolded sheet material into a box template and a box template production system is achieved where reduced force is needed for guiding the sheet material into the converting part of the system. Furthermore reduced space is needed for this system compared to prior art systems because of the shortened way to travel for the sheet material before it enters the converting part of the system.

In one embodiment of the invention said angle is between 30 and 70 degrees.

In one embodiment of the invention said fanfolded sheet material is provided to the system from at least one fanfold bale positioned at an inlet side of the system, wherein said box template production system comprises at least one feed guide configured for receiving the sheet material from the fanfold bale and guiding it up to a top position, wherein the converting part of the system is configured for receiving the sheet material from the at least one feed guide or from one or more connecting guide parts on its way down from the top position.

In one embodiment of the invention only one feed guide is provided for each sheet material and said feed guide is configured for receiving the sheet material such that it slides over the feed guide. The at least one feed guide is configured for allowing the sheet material to tilt sideways around the feed guide on its way up to the top position thereby enabling correction of the feeding direction of the sheet material. Correction might be needed due to a material bale that is off the nominal position, or placed at an angle towards the feeding direction. Hereby the guiding of the sheet material will be facilitated and will be requiring less force. A shorter transport way before the sheet material enters the converting part and reduced friction will require less force than in prior art systems. Furthermore a fanfold bale provided in a slightly wrong position at the inlet to the system can still be handled because the direction of the sheet material through the system can be corrected.

In one embodiment of the invention the at least one feed guide is provided as an arc starting at a start position where the sheet material is provided to the feed guide, said arc further comprising the top position, wherein said feed guide has a width being less than one fifth of the width of the sheet material.

In one embodiment of the invention the system comprises a printer configured and positioned for printing on the sheet material in a direction being perpendicular to the feed direction of the sheet material when the sheet material is converted in the converting part of the system. Because of the tilted position of the printer printing capabilities are improved compared to prior art systems where printing often is provided directly from below, i.e. an underside of the sheet material is printed because this will later be an outside of the box and the printer is often provided together with the converting part in the system. However printing upwards is not ideal because dust and dirt can cover the printer heads and gravity force can counteract the printing effectivity. Hereby with this system the printing is provided to the sheet material not directly from below but from an angle corresponding to the angle defined above. This provides a more effective printing system which is less prone to the problems caused by dirt and dust covering the printer heads.

DETAILED DESCRIPTION OF EMBODIMENTS

The invention relates to a box template production system comprising a converting part which is configured for converting a fanfolded sheet material into box templates. According to the invention said converting is accomplished to the sheet material when a feed direction of the sheet material through the converting part of the system is along an axis having an angle towards a plane of a floor onto which the system stands, wherein said angle is between 20 and 90 degrees or suitably between 30 and 70 degrees.

The sheet materials used for forming the box templates according to the invention could be e.g., paperboard, corrugated board or cardboard. The term cardboard is used in the text and claims and intends to cover all these examples. As used herein, the term "box template" shall refer to a substantially flat stock of material that can be folded into a box-like shape. A box template may have notches, cutouts, divides, and/or creases that allow the box template to be bent and/or folded into a box. Additionally, a box template may be made of any suitable material, generally known to those skilled in the art. For example, cardboard or corrugated paperboard may be used as the template material.

Figure 1:
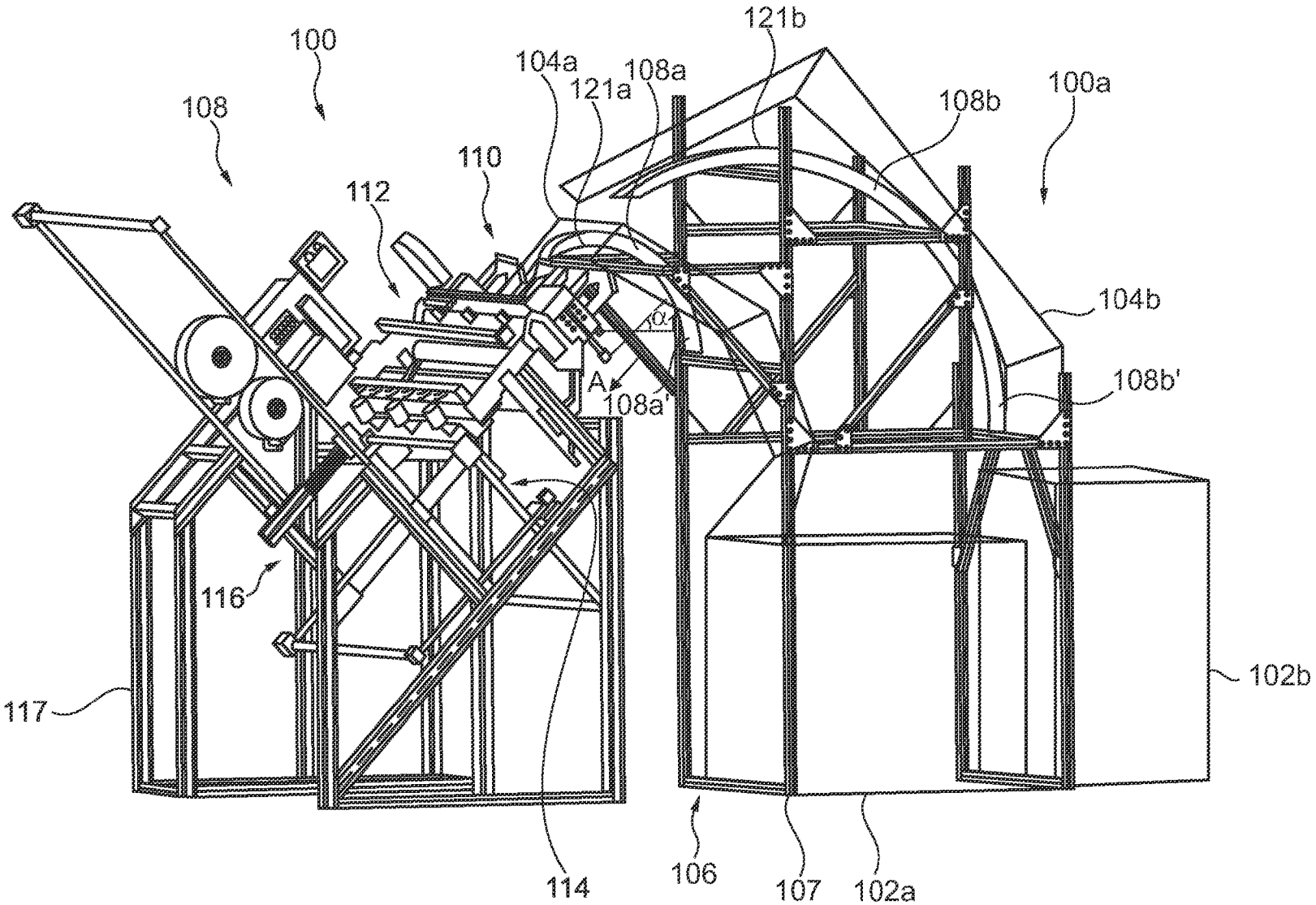
FIG. 1 shows schematically a box template production system according to one embodiment of the invention.

FIG. 1 illustrates schematically a perspective view of a box template production system 100 according to one embodiment of the invention. The system 100 is configured for receiving sheet material 104*a*, 104*b* from bales 102*a*, 102*b* of fanfolded sheet material 104*a*, 104*b*. One or more bales 102*a*, 102*b* can be provided side by side and/or in a queue at an inlet side 100*a* of the system 100. The bales 102*a*, 102*b* may be formed of sheet material 104*a*, 104*b* that have different characteristics (e.g., widths, lengths, thickness, stiffness, color, etc.) from one another. As illustrated in FIG. 1, for instance, the width of the bale 102*a* may be smaller than the width of the bale 102*b*. Thus, it may be desirable to use the sheet material 104*a* from the bale 102*a* to form a smaller box so there is less sheet material wasted.

The system 100 comprises a feeding part 106 provided for guiding the sheet material 104*a*, 104*b* into a processing part 108 of the system. The processing part 108 of the system comprises a frame 117 holding a converting part 112 and some other parts briefly described below. The converting part 112 converts the sheet material into box templates by for example cutting and creasing the material as described above. The feeding part 106 comprises a frame 107 which holds one or more feed guides 108*a*, 108*b*. In this shown embodiment two feed guides 108*a*, 108*b* are provided, one for each bale 102*a*, 102*b*. The feed guides 108*a*, 108*b* are configured for receiving the sheet material 104*a*, 104*b* from the fanfold bales 102*a*, 102*b* and guiding it up to a top position 121*a*, 121*b*, wherein the converting part 112 of the system is configured for receiving the sheet material 104*a*, 104*b* from the at least one feed guide 108*a*, 108*b* or from one or more connecting guide parts on its way down from the top position 121*a*, 121*b*. In this embodiment a feed changer 110 is provided between the feed guides 108*a*, 108*b* and the converting part 112 of the system.

The feed changer 110 is in this embodiment a connecting guide part between the feed guides 108*a*, 108*b* and the converting part 112 of the system. The feed changer 110 controls from which bale 102*a*, 102*b* sheet material 104*a*, 104*b* should be provided into the converting part 112 of the system 100. In another embodiment further connecting guide parts could be provided between the feed guides 108*a*, 108*b* and the converting part 112.

In this embodiment it can be seen that the converting part 112 of the system 100 is provided in a tilted position, i.e. the feed direction of a sheet material when passing through the converting part 112 is not parallel to a plane of the floor as is the case in prior art systems. As described in the claims the converting of the sheet material into a box template is accomplished to the sheet material when a feed direction of the sheet material through the converting part of the system is along an axis A having an angle $\alpha$ towards a plane of a floor onto which the system stands, wherein said angle $\alpha$ is between 20 and 90 degrees or suitably between 30 and 70 degrees. In the embodiment shown in FIG. 1 the angle $\alpha_1$ is shown to be somewhere between 30 and 70 degrees. This will also be described as a tilted converting part in this patent application. The benefits in providing a tilted converting part is that less force will be required to guide the sheet material into the converting part compared to if the converting part is provided in a horizontal direction further down towards the floor. A horizontal direction requires further distances, bending and friction of the sheet material, i.e. the feed direction of the sheet material through the system needs to be changed more when the sheet material should enter a horizontally provided converting part than what is required for entering the tilted converting part of the system according to the invention.

In the embodiment of the invention shown in FIG. 1 only one feed guide 108*a*, 108*b* is provided for each sheet material 104*a*, 104*b*. This is however not necessary for the invention. A system having a tilted converting part 112 according to the invention could be provided with another type of feeding of the sheet material into the converting part 112, such as for example one or more rails or wheels for each sheet material. However in the embodiment shown in FIG. 1 said feed guide 108*a*, 108*b* is configured for receiving the sheet material 104*a*, 104*b* such that the sheet material is sliding over the feed guide. In this embodiment the feed guide 108*a*, 108*b* is positioned such that it touches the sheet material 104*a*, 104*b* somewhere in a middle third part of a width of the sheet material 104*a*, 104*b*. However this is more important for sheet materials having a larger width than for less wide sheet material. The at least one feed guide 108*a*, 108*b* is configured for allowing the sheet material 104*a*, 104*b* to tilt sideways around the feed guide 108*a*, 108*b* on its way up to the top position 121*a*, 121*b* thereby enabling correction of the feeding direction of the sheet material 104*a*, 104*b*. Compared to using for example two feed guides for the feeding of each sheet material it is easier to guide and correct directions of the sheet material when only one feed guide is provided. The material and surface of the feed guide 108*a*, 108*b* can be provided such that the sheet material 104*a*, 104*b* can slide over the feed guide and tilt sideways, such as for example low friction metal or plastic, or even a set of small wheels providing rolling friction rather than glide friction. This is in contrast to a material of a single larger wheel sometimes used for the feeding of sheet material into a converting part of the system.

Furthermore in the embodiment shown in FIG. 1 the at least one feed guide 108*a*, 108*b* is provided as an arc starting at a start position 108*a*', 108*b*' where the sheet material 104*a*, 104*b* is provided to the feed guide 108*a*, 108*b*, said arc further comprising the top position 121*a*, 121*b*. Said feed guide 108*a*, 108*b* can have a width being less than one fifth of the width of the sheet material. A wider feed guide would decrease the possibilities to tilt the sheet material sideways and change direction during the feeding. In this embodiment the arc continues after the top position 121*a*, 121*b* further down towards the feed changer 110 and the converting part 112. However the arc could in another embodiment end at the top position 121*a*, 121*b* and possibly be connected to the feed changer 110 or directly to the converting part 112 through another connecting guide part.

In the embodiment shown in FIG. 1 the processing part 108 of the system 100 also comprises a fold assembly 114, and an attachment assembly 116 which are mounted on or connected to the frame 117. These components are however not relevant for the present invention and will not be described in more detail here. In another embodiment of the invention no folding of boxes is provided in the system. The system only delivers box templates.

Figure 2A:
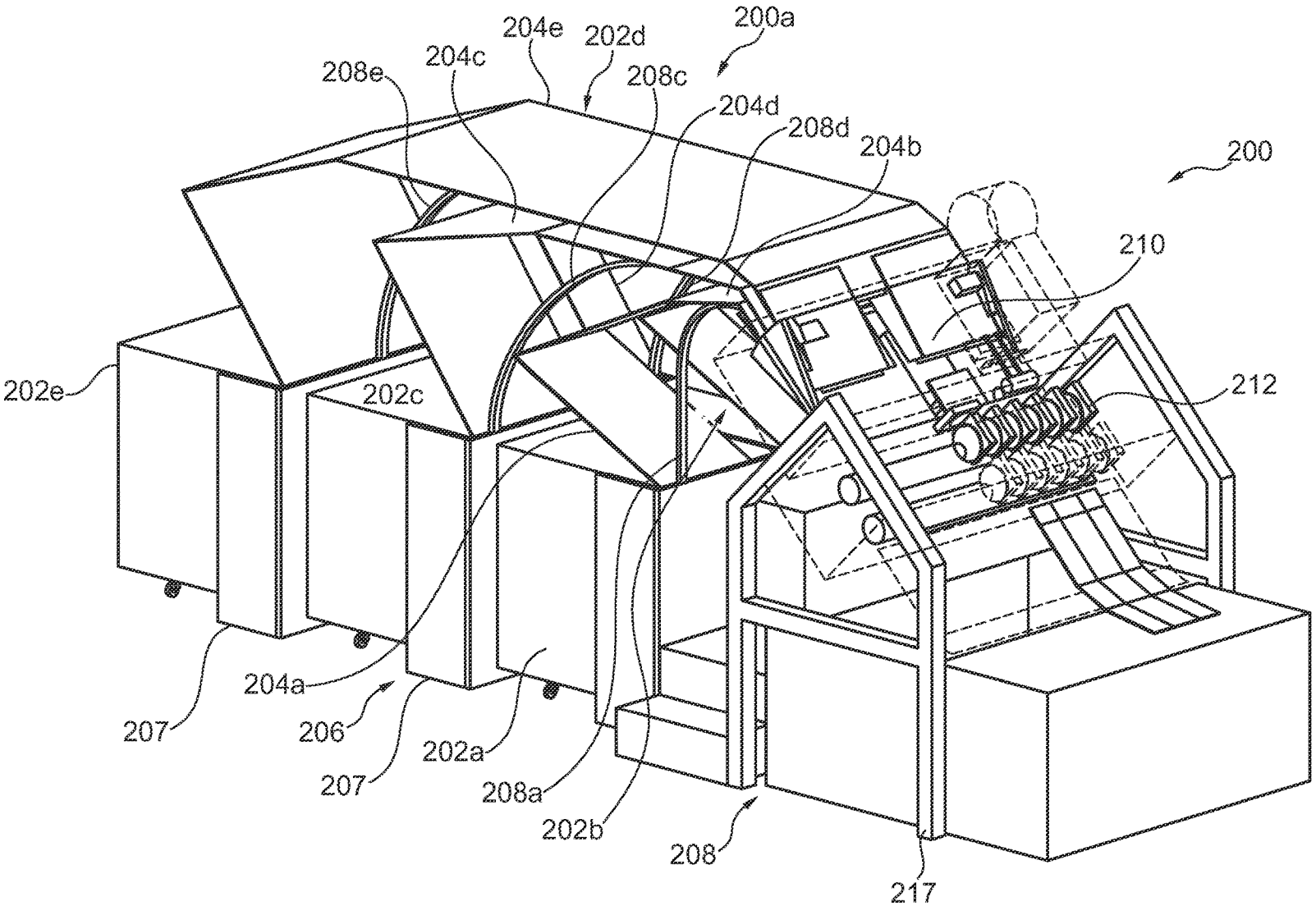
FIG. 2*a* shows schematically a perspective view of a box template production system according to another embodiment of the invention.
Figure 2B:
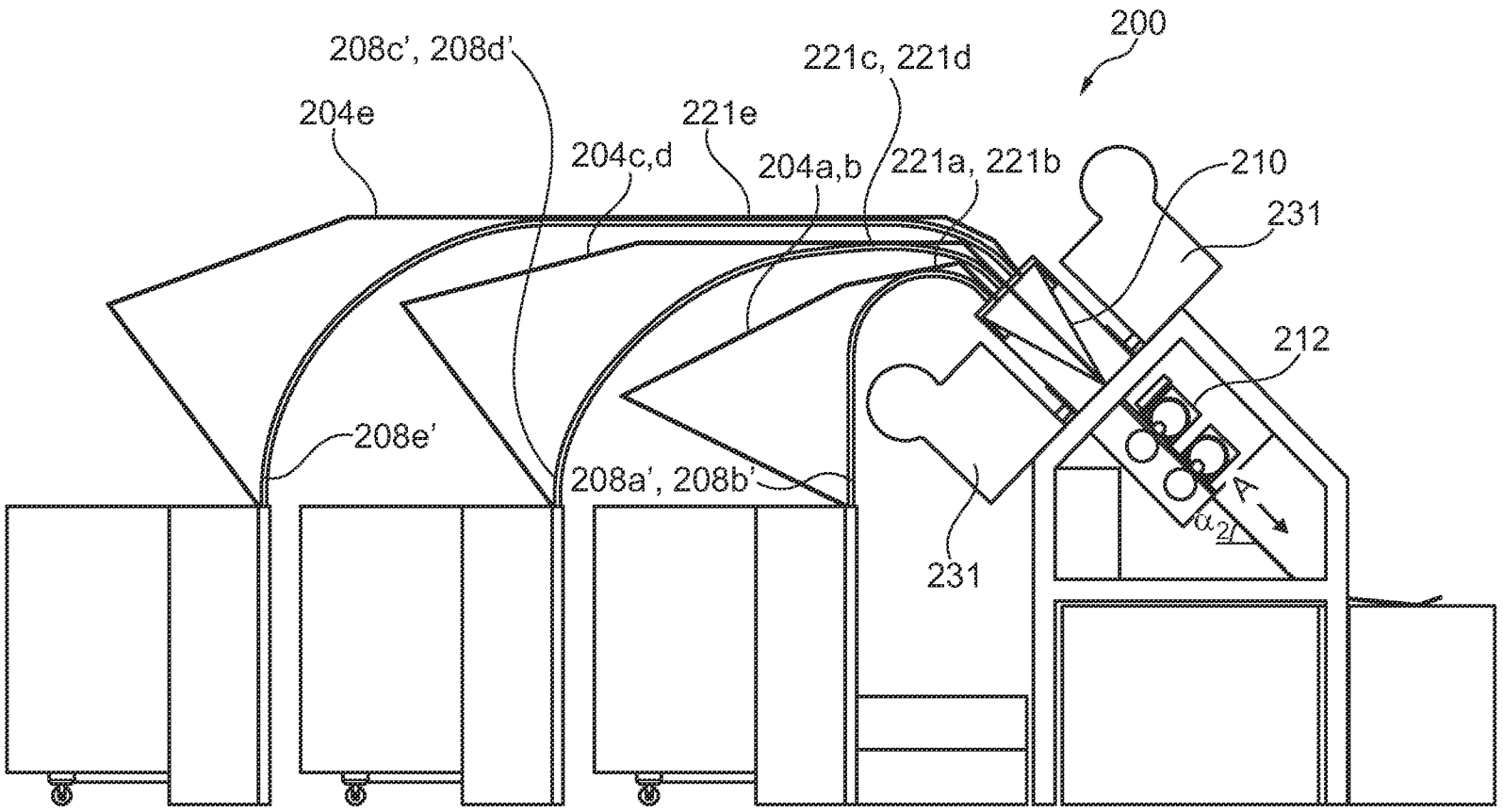
FIG. 2*b* shows a side view of the box template production system as shown in FIG. 2*a*.

FIG. 2*a* shows schematically a perspective view of a box template production system 200 according to another embodiment of the invention. FIG. 2*b* shows the same embodiment as shown in FIG. 2*a* in a side view. In this embodiment a system 200 is provided without folding and assembling parts as shown in relation to FIG. 1. Many of the details in this embodiment are the same or very similar to the corresponding details in the embodiment shown in relation to FIG. 1 and these details will be given corresponding reference numbers but in the 200-series and will not be described in detail. A converting part 212 of the system is also in this embodiment tilted, i.e. the feed direction of a sheet material when transferred through and converted by the converting part 212 is along an axis A having an angle $\alpha$ towards a plane of the floor into which the system stands. This angle can be seen in FIG. 2*b*. The angle $\alpha_2$ is in this embodiment between 30 and 70 degrees. In this embodiment of the system the system 200 is configured for receiving sheet material 204*a*-204*e* from bales 202*a*, 202*b*, 202*c*, 202*d*, 202*e* of fanfolded sheet material 204*a*-204*e*. One or more bales 202*a*, 202*b*, 202*c*, 202*d*, 202*e* can be provided side by side and/or in a row after each other at an inlet side 200*a* of the system 200. The bales 202*a*, 202*b*, 202*c*, 202*d*, 202*e* may be formed of sheet material 204*a*-204*e* that have different characteristics (e.g., widths, lengths, thickness, stiffness, color, etc.) from one another. As illustrated in FIGS. 2*a* and 2*b*, for instance, one to five different bales can provided at the same time to the system 200.

The system 200 comprises a feeding part 206 provided for guiding the sheet material 204*a*-204*e* into a processing part 208 of the system. The processing part 208 of the system comprises a frame 217 holding a converting part 212 and a feed changer 210. The converting part 112 converts the sheet material into box templates by for example cutting and creasing the material as described above. The feeding part 206 comprises a frame 207 which holds one or more feed guides 208*a*, 208*b*, 208*c*, 208*d*, 208*e*. In this shown embodiment five feed guides 208*a*, 208*b*, 208*c*, 208*d*, 208*e* are provided, one for each bale 202*a*, 202*b*, 202*c*, 202*d*, 202*e*. The feed guides 208*a*, 208*b*, 208*c*, 208*d*, 208*e* are configured for receiving the sheet material 204*a*-204*e* from the fanfold bales 202*a*, 202*b*, 202*c*, 202*d*, 202*e* and guiding it up to a respective top position 221*a*, 221*b*, 221*c*, 221*d*, 221*e*, wherein the converting part 212 of the system is configured for receiving the sheet material 204*a*-204*e* from the at least one feed guide 208*a*, 208*b*, 208*c*, 208*d*, 208*e* or from one or more connecting guide parts on its way down from the top position 221*a*, 221*b*, 221*c*, 221*d*, 221*e*. In this embodiment a feed changer 210 is provided between the feed guides 208*a*-208*e* and the converting part 212 of the system. The feed changer 210 is in this embodiment a connecting guide part between the feed guides 208*a*-208*e* and the converting part 212 of the system. The feed changer 210 controls from which bale 202*a*-202*e* sheet material 204*a*-204*e* should be provided into the converting part 212 of the system 200.

In the embodiment of the invention shown in FIGS. 2*a* and 2*b* only one feed guide 208*a*-208*e* is provided for each sheet material 204*a*-204*e*. Said feed guide 208*a*-208*e* is configured for receiving the sheet material 204*a*-204*e* such that the sheet material is sliding over the feed guide. In some embodiments the feed guides may be positioned such that they touch the sheet material 204*a*-204*e* somewhere towards a middle part of the width of the sheet material, possibly in a middle third part of a width of the sheet material 204*a*-204*e*. However this is more important for sheet materials having a larger width than for less wide sheet material. This is shown in FIG. 2*a* where the feed guide 208*e* is provided to receive sheet material 204*a* from the bale 202*e* substantially in the middle of the sheet material width. However some of the other feed guides 208*a*, 208*c* are not necessarily receiving the sheet material having a smaller width in a middle position. The at least one feed guide 208*a*-208*e* is configured for allowing the sheet material 204*a*-204*e* to tilt sideways around the feed guide 208*a*-208*e* on its way up to the top position 221*a*-221*e* thereby enabling correction of the feeding direction of the sheet material 204*a*-204*e*.

Furthermore in the embodiment shown in FIGS. 2*a* and 2*b* the at least one feed guide 208*a*-208*e* is provided as an arc starting at a start position 208*a*'-208*e*' where the sheet material 204*a*-204*e* is provided to the feed guide 208*a*-208*e*, said arc further comprising the top position 221*a*-221*e*. Said feed guide 208*a*-208*e* can have a width being less than one fifth of the width of the sheet material. A wider feed guide would decrease the possibilities to tilt the sheet material sideways and change direction during the feeding. In this embodiment the arc continues after the top position 221*a*-221*e* further down towards the feed changer 210 and the converting part 212. However the arc could in another embodiment end at the top position 221*a*-221*e*.

In one embodiment of the invention the converting part 212 of the system 200 comprises a printer 231 configured and positioned for printing on the sheet material 204*a*-204*e* in a direction being perpendicular to the feed direction of the sheet material 204*a*-204*e* when the sheet material is converted in the converting part 212 of the system 200. In the embodiment shown in FIGS. 2*a* and 2*b* two printers 231 are shown, one for printing on each side of the sheet material when passing through the feed changer 210 and the converting part 212. The position of the printers 231 can be varied within the system 200 but the printing is suitably provided with the same tilt as the converting part 212. Printing to the sheet material 204*a*-*e* needs sometimes to be provided from the underside of the sheet material because this will often later form an outside of the box and printing from the underside may be complicated due to gravitational force and dirt and dust covering the printing heads. Hereby it is advantageous to provide the printer with a tilt as shown in this embodiment compared to some prior art systems where printing is provided directly from below in a horizontal position. A printer could also be provided to the embodiment shown in FIG. 1.

Figure 3A:
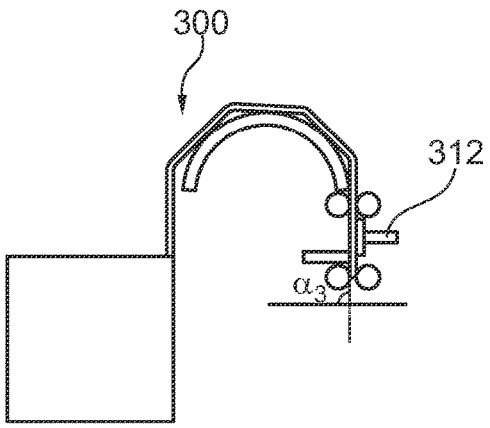
FIG. 3*a* shows schematically a box template production system according to another embodiment of the invention.

FIG. 3*a* shows schematically a box template production system 300 according to another embodiment of the invention. In this embodiment a converting part 312 of the system is provided in a vertical position, i.e. the feed direction of a sheet material through the converting part 312 of the system 300 is along an axis having an angle $\alpha$ towards a plane of a floor onto which the system stands, wherein said angle $\alpha_3$ is 90 degrees.

Figure 3B:
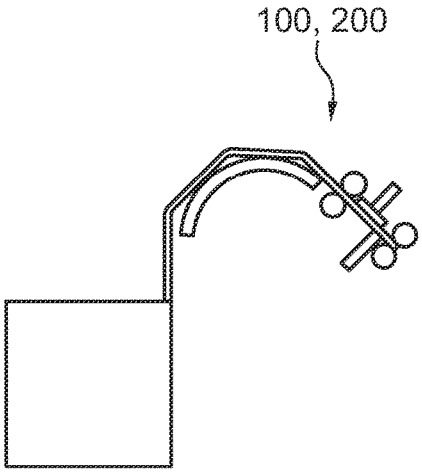
FIG. 3*b* shows schematically a box template production system according to one embodiment of the invention which embodiment could be both the one shown in FIG. 1 and the one shown in FIGS. 2*a* and 2*b*.

FIG. 3*b* shows schematically a box template production system 100, 200 according to one embodiment of the invention which embodiment could be both the one shown in FIG. 1 and the one shown in FIGS. 2*a* and 2*b*.

Figure 4:
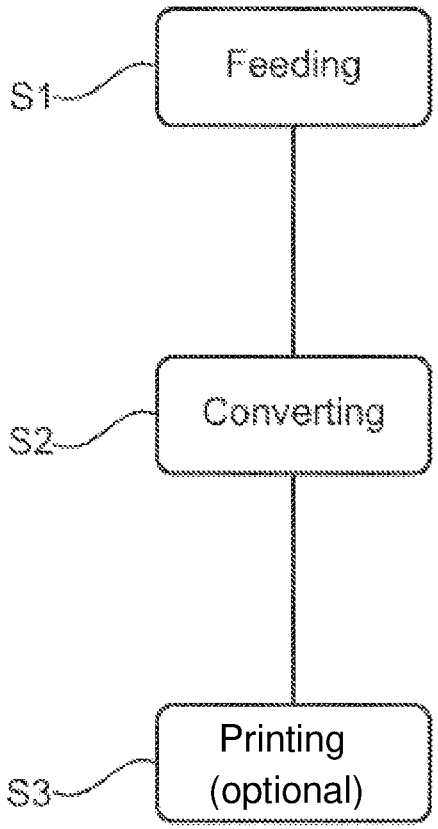
FIG. 4 is a flow chart of a method according to one embodiment of the invention.

FIG. 4 is a flow chart of a method for converting a fanfolded sheet material into a box template according to one embodiment of the invention. The method steps are described in order below:

S1: Feeding the sheet material 104*a*-*b*; 204*a*-*e* into a box template production system 100; 200, 300.

S2: Converting the sheet material 104*a*-*b*; 204*a*-*e* into box templates when a feed direction of the sheet material 104*a*-*b*; 204*a*-*e* through a converting part 112; 212; 312 of the box template production system 100; 200; 300 is along an axis having an angle towards a plane of a floor onto which the system stands, wherein said angle is between 20 and 90 degrees or in another embodiment between 30 and 70 degrees.

In one embodiment of the invention the step of feeding, S1, comprises guiding the sheet material 104*a*-*b*; 204*a*-*e* into the box template production system 100; 200; 300 by at least one feed guide 108*a*, 108*b*; 208*a*-208*e*, wherein said guiding comprises guiding the sheet material up to a top position 121*a*, 121*b*; 221*a*-221*e* and then further down from the top position to the converting part 112; 212; 312 of the system.

In one embodiment of the invention the step of feeding, S1, further comprises providing the sheet material 104*a*-*b*; 204*a*-*e* from at least one fanfold bale 102*a*, 102*b*; 202*a*-202*e* to only one feed guide 108*a*, 108*b*; 208*a*-208*e* for each sheet material 104*a*-*b*; 204*a*-*e* such that the feed guide 108*a*, 108*b*; 208*a*-208*e* is positioned somewhere in a middle third part of a width of the sheet material thus allowing the sheet material to tilt sideways around the feed guide on its way up to the top position thereby enabling correction of the feeding direction of the sheet material.

In one embodiment of the invention the method further comprises the optional step:

S3: Printing on the sheet material 104*a*-*b*; 204*a*-*e* in a direction being perpendicular to the feed direction of the sheet material when the sheet material is converted in the converting part 112; 212 of the system.

In another aspect of the invention a box template production system configured for converting a fanfolded sheet material into box templates is provided, wherein said box template production system comprises at least one feed guide configured for receiving sheet material from fanfold bales and guiding it up to a top position. In this aspect of the invention a conversion part of the system can be provided both tilted or not tilted, i.e. the converting of sheet material to a box template can be accomplished when a feed direction of the sheet material through the converting part of the system is along a floor plane or tilted as described above. In this aspect of the invention a converting part of the system is configured for receiving the sheet material from the at least one feed guide or from one or more connecting guide parts, wherein only one feed guide is provided for each sheet material and wherein said feed guide is configured for receiving the sheet material such that the sheet material slides over the feed guide. The at least one feed guide is configured for allowing the sheet material to tilt sideways around the feed guide on its way up to the top position thereby enabling correction of the feeding direction of the sheet material as described above.

In one embodiment of the invention the at least one feed guide is provided as an arc starting at a start position where the sheet material is provided to the feed guide, said arc further comprising the top position, wherein said feed guide has a width being less than one fifth of the width of the sheet material. The material and surface of the feed guide 108*a*, 108*b*; 208*a*-208*e* can be provided such that the sheet material 104*a*-*b*; 204*a*-*e* can slide over the feed guide and tilt sideways, such as for example low friction metal or plastics, or even a set of small wheels providing roller friction rather than glide friction.

The invention claimed is:

1. A box template production system comprising:

a converting part which is configured for cutting or creasing a sheet material from at least one sheet material source to convert the sheet material into box templates, wherein the converting is performed to the sheet material when a feed direction of the sheet material through the converting part of the system is along an axis having an angle towards a plane of a floor onto which the system stands, wherein the angle is between 20 and 90 degrees;

a plurality of feed guides configured for receiving the sheet material from the at least one sheet material source, wherein only one feed guide of the plurality of feed guides is provided for each sheet material source, wherein each feed guide is configured for allowing the sheet material to tilt sideways around the feed guide, and a feed changer provided between the plurality of feed guides and the converting part, the feed changer being configured to control from which sheet material source sheet material is provided to the converting part, wherein the feed changer is configured to receive the sheet material from each feed guide in a downward direction relative to the plane of the floor.

2. The box template production system according to claim 1, wherein the angle is between 30 and 70 degrees.

3. The box template production system according to claim 1, wherein the at least one sheet material source is positioned at an inlet side of the system, wherein each of the plurality of feed guides is configured for guiding the sheet material up to a top position, wherein the converting part of the system is configured for receiving the sheet material from the plurality of feed guides or from one or more connecting guide parts on its way down from the top position.

4. The box template production system according to claim 3, wherein each feed guide is configured for receiving the sheet material such that it slides over the feed guide.

5. The box template production system according to claim 1, wherein each of the plurality of feed guides is provided as an arc starting at a start position where the sheet material is provided to the respective feed guide, the arc further comprising a top position, wherein each of the plurality of feed guides has a width being less than one fifth of the width of the sheet material.

6. The box template production system according to claim 1, wherein the system further comprises a printer configured and positioned for printing on the sheet material in a direction being perpendicular to the feed direction of the sheet material when the sheet material is converted in the converting part of the system.

7. A method for converting a sheet material into a box template, wherein the method comprises the steps of:

selecting with a feed changer a sheet material from a plurality of sheet material sources;

feeding the selected sheet material into a box template production system over one feed guide of a plurality of feed guides, each feed guide being associated with sheet material from a separate sheet material source of the plurality of sheet material sources, wherein the feed changer is configured to receive the sheet material from each feed guide in a downward direction relative to a plane of a floor onto which the system stands, wherein feeding the selected sheet material comprises allowing the sheet material to tilt sideways around the feed guide;

converting the sheet material into box templates when a feed direction of the sheet material through a converting part of the box template production system is along an axis having an angle towards the plane of the floor, wherein the angle is between 20 and 90 degrees.

8. The method according to claim 7, wherein the angle is between 30 and 70 degrees.

9. The method according to claim 7, wherein the step of feeding comprises guiding the sheet material into the box template production system by the one feed guide of the plurality of feed guides, wherein the guiding comprises guiding the sheet material up to a top position and then further down from the top position to the converting part of the system.

10. The method according to claim 7, further comprising printing on the sheet material in a direction being perpendicular to the feed direction of the sheet material when the sheet material is converted in the converting part of the system.

11. A box template production system configured for converting a sheet material into box templates, wherein the box template production system comprises:

a plurality of feed guides, each feed guide configured for receiving sheet material from sheet material sources and guiding it up to a top position, wherein each feed guide is configured for allowing the sheet material to tilt sideways around the feed guide;

a converting part configured for receiving the sheet material from each of the plurality of feed guides or from one or more connecting guide parts, the converting part being configured to cut or crease the sheet material to convert the sheet material into box templates, wherein a feed direction of the sheet material through the converting part is along an axis having an angle towards a plane of a floor onto which the system stands, wherein said angle is between 20 and 90 degrees, wherein only one feed guide of the plurality of feed guides is provided for each sheet material source and wherein each feed guide is configured for receiving an associated sheet material such that the associated sheet material slides over the feed guide; and a feed changer provided between the plurality of feed guides and the converting part, the feed changer being configured to select which sheet material is fed into the converting part, wherein the feed changer is configured to receive the sheet material from each feed guide in a downward direction relative to the plane of the floor.

12. The box template production system according to claim 11, further comprising a printer configured and positioned for printing on the sheet material in a direction being perpendicular to the feed direction of the sheet material when the sheet material is converted in the converting part of the system.

13. The box template production system according to claim 11, wherein each feed guide of the plurality of feed guides is provided as an arc starting at a start position where the sheet material is provided to the feed guide, the arc further comprising the top position, wherein the feed guide has a width being less than one fifth of a width of the sheet material.

* * * * *